US005140624A

United States Patent [19]

Chrisien

[11] Patent Number: 5,140,624

[45] Date of Patent: Aug. 18, 1992

[54] APPARATUS FOR ROTATABLY SUPPORTING AN X-RAY TUBE ANODE

[75] Inventor: Dale G. Chrisien, Brookfield, Wis.

[73] Assignee: General Electric Company, Milwaukee, Wis.

[21] Appl. No.: 680,869

[22] Filed: Apr. 5, 1991

[51] Int. Cl.[5] ..... H01J 35/10

[52] U.S. Cl. ..... 378/132; 378/125

[58] Field of Search ..... 378/132, 133, 125

[56] References Cited

U.S. PATENT DOCUMENTS 4,856,039 8/1989 Roelandse et al. ..... 378/132

4,914,684 4/1990 Upadhya ..... 378/133

*Primary Examiner*—Craig E. Church

*Attorney, Agent, or Firm*—James O. Skarsten; Douglas E. Stoner

[57] ABSTRACT

In an X-ray tube having a stationary anode stem, a shaft joined to the tube anode, and a rotary bearing to support the shaft and anode for rotation relative to the stem, a preloading element is positioned in a bore formed in the stem and is axially displaceable to apply a selected preload to the bearing. The preloading element has a cylindrical outer surface provided with longitudinal spaced-apart grooves in parallel relationship with the bore axis. A locking ball positioned in each groove extends through a complementary hole formed through the stem to oppose rotational displacement of the preloading element with respect to the stem, while allowing axial displacement to take place. An annular retaining ring positioned around the anode stem engages the locking balls to urge them in toward the bore, and to oppose radial displacement of the preloading element.

10 Claims, 2 Drawing Sheets

APPARATUS FOR ROTATABLY SUPPORTING AN X-RAY TUBE ANODE

BACKGROUND OF THE INVENTION

The invention disclosed and claimed herein is directed to apparatus for supporting an X-ray tube anode for rotation. More particularly, the invention pertains to apparatus of such type having an element which is locked against rotational and radial movement, but is free to move axially to preload rotary bearings carrying the anode, and to take up expansion and contraction in the bearings resulting from heating effects.

The principal component of conventional X-ray equipment and computed tomography (CT) equipment is an X-ray tube which provides the source of X-rays. Such tubes contain a vacuum at $10^{-8}$ to $10^{-9}$ torr and operate by accelerating a stream of electrons from a heated cathode through a high voltage against a target anode. The conversion efficiencies of such tubes are low and therefore considerable heat is generated in the anode as a by-product of the X-ray generation.

In order to reduce heat concentration in the anode, the anode is mounted on an anode shaft and rotated at speeds up to 12,000 RPM, thereby continuously presenting the cathode a new and cooler surface. In a high performance X-ray tube, the surface of the anode may reach temperatures of 3,200° C., and areas of the anode outside the immediate target surface may rise to temperatures of approximately 1,300° C.

Much of the heat generated in the anode is radiated through the glass walls of the tube from high emissivity anode coatings. Even so, the anode shaft, as well as the support bearings which rotatably carry the shaft and anode, may rise to temperatures of up to 450° C.

Each of the bearings for the anode shaft typically comprises a rolling contact ball bearing, that is, an annular train of rolling balls trapped between inner and outer races. The bearings are generally preloaded, to prolong bearing life. In a common arrangement, a front bearing is held fixed with respect to a stationary support member known as the anode stem, and the outer race of the rear bearing is carried on a cylindrical element known as a bearing retainer. The bearing retainer and rear bearing outer race are free to slide axially within a bore formed in the anode stem, and the rear bearings' inner race is fixed to the anode shaft. A preload spring applies an axial force to the rear bearing retainer to urge the outer bearing race rearwardly and to thereby apply a preloading force to the rear bearing. The axial force provided by the spring is also transmitted through the anode shaft to preload the front bearings. The preloading force improves the tracking of the bearing balls in their annular path between the inner and outer races of both front and rear bearings, increasing bearing life and reducing bearing noise. More particularly, the preloading provides a constant axial force (thrust load) on the bearings to distribute translated radial forces of the rotating anode between multiple rolling annular contact elements, that is, the balls rolling between the inner and outer races.

Arrangements of the above type are shown, for example, in commonly assigned U.S. Pat. No. 4,914,684, issued Apr. 3, 1990 to Kamleshwar Upadhya.

The axially slidable bearing retainer provides a further benefit in allowing axial expansion and contraction of the bearings, which occurs as the mechanism heats or cools. However, in order for the bearing retainer to move axially, it must be "slip fitted" within the bore of the anode stem, i.e., a slight clearance must be allowed between the bore wall and the outer cylindrical surface of the bearing retainer. Such clearance may be on the order of 0.001 inch to 0.003 inch by design, and stem bore out-of-roundness caused by machining can account for an additional 0.001 inch–0.002 inch in radial clearance. The resulting total clearance may be large enough to allow radial movement or "radial play" of the bearing retainer within the bore. Also, a rotational moment caused by stick/slip friction of the bearing can cause impacts of occur between the bearing retainer and an "anti-rotation" screw which, as shown in the Upadhya patent referred to above, is positioned between the bearing retainer and the anode stem to prevent the bearing retainer from rotating within the stem. Such undesirable mechanical movements are the primary cause of bearing noise in certain commercially important types of X-ray tubes. Also, vibration resulting therefrom can accelerate wear of contacting surfaces, and small metallic particles, caused by the wear, can become distributed in the bearings and even enter the vacuum tube itself. Such metallic particles have the effect of further increasing bearing noise, decreasing the life of the X-ray tube rotor and reducing high voltage stability for X-ray tube operation. Radial vibration between the rear bearing retainer and the stem can also create a high voltage current path from the anode stem to the bearing shaft, which would be highly undesirable.

SUMMARY OF THE INVENTION

The invention provides, in an X-ray tube having a mounting structure and an anode, apparatus for supporting the anode for rotation with respect to the mounting structure. The apparatus comprises first and second elongated members, the first member being fixed to the mounting structure, and the second member being fixed to the anode. One of the members is provided with a bore, and both members are aligned along the bore axis. The apparatus further includes a bearing positioned proximate to the bore for supporting the anode and the member fixed to the anode for rotation with respect to the other member. A preloading element is positioned in the bore for displacement along the bore axis to selectively preload the bearing, the preloading element having an outer surface provided with a plurality of grooves oriented in parallel relationship with the axis. A locking means is located in each of the grooves for engaging the member in which the bore is formed, to limit movement of the preloading element, with respect to such member, to translational movement along the bore axis. Means are also provided to apply a force to the preloading element through the locking means to prevent the preloading element from moving radially within the bore.

Preferably, the bore is formed in the first member, that is, the member fixed to the mounting structure, and each of the locking means comprises a locking ball, a portion of each ball being in one of the grooves, and another portion extending through a corresponding hole formed through the bore wall of the first member. The retaining means comprises means for applying a uniform force to each of the locking balls, to urge each of the balls toward the bore, and into tightly contacting relationship with the preloading element.

In a preferred embodiment, three grooves are formed in a cylindrical outer surface of the preloading element.

The grooves, as well as the corresponding holes through the bore wall, are spaced apart radially from one another at 120°.

An object of the invention is to provide an improved mechanism for applying a preload to the anode support bearings in an X-ray tube having a rotary anode.

Another object is to provide a mechanism of the above type having a bearing preload element which is axially displaceable along a bore to apply a selected preload force to the bearings, and at the same time is constrained against radial and rotational movements within the bore to minimize noise, wear and vibrations.

Another object is to provide a mechanism of the above type wherein a bearing, or portion thereof, is carried upon the preloading element for selected displacement along the bore.

These and other objects and advantages will become more readily apparent from the following description, taken in conjunction with the accompanying drawings.

DETAILED DESCRIPTION OF THE PREFERRED EMBODIMENT

Figure 1:
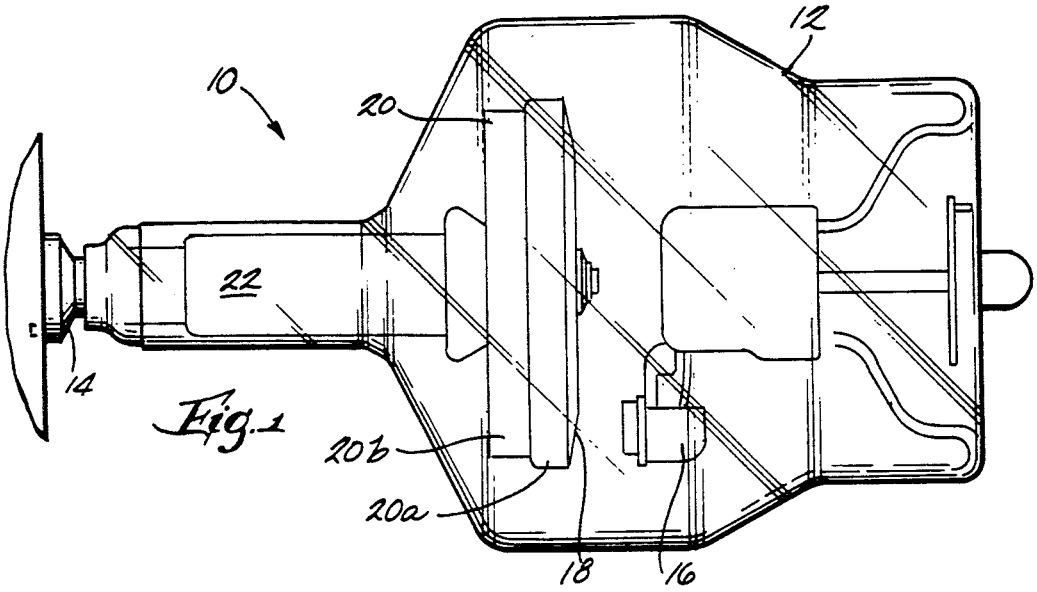
FIG. 1 is a perspective view showing an X-ray tube which employs an embodiment of the invention.

FIG. 1 shows an X-ray tube 10 which is of conventional design, except that tube 10 includes an embodiment of the invention as hereinafter described. Tube 10 generally comprises a glass envelope 12 fixed to a mounting bracket 14, the envelope 12 providing a vacuum enclosure for the remaining components of tube 10. Tube 10 further comprises a cathode 16, fixed in relation to envelope 12, for directing a stream of electrons onto a track 18 of an anode 20, which is continually rotated by means of anode drive and support structure 22, described hereinafter. Anode 20 typically comprises disk portions 20*a* and 20*b* of selected materials, while track 18 has an annular configuration and is formed of tungsten. As anode 20 rotates, the stream of electrons from cathode 16 impinges upon a continually changing portion of track 18 to generate X-rays.

Figure 2:
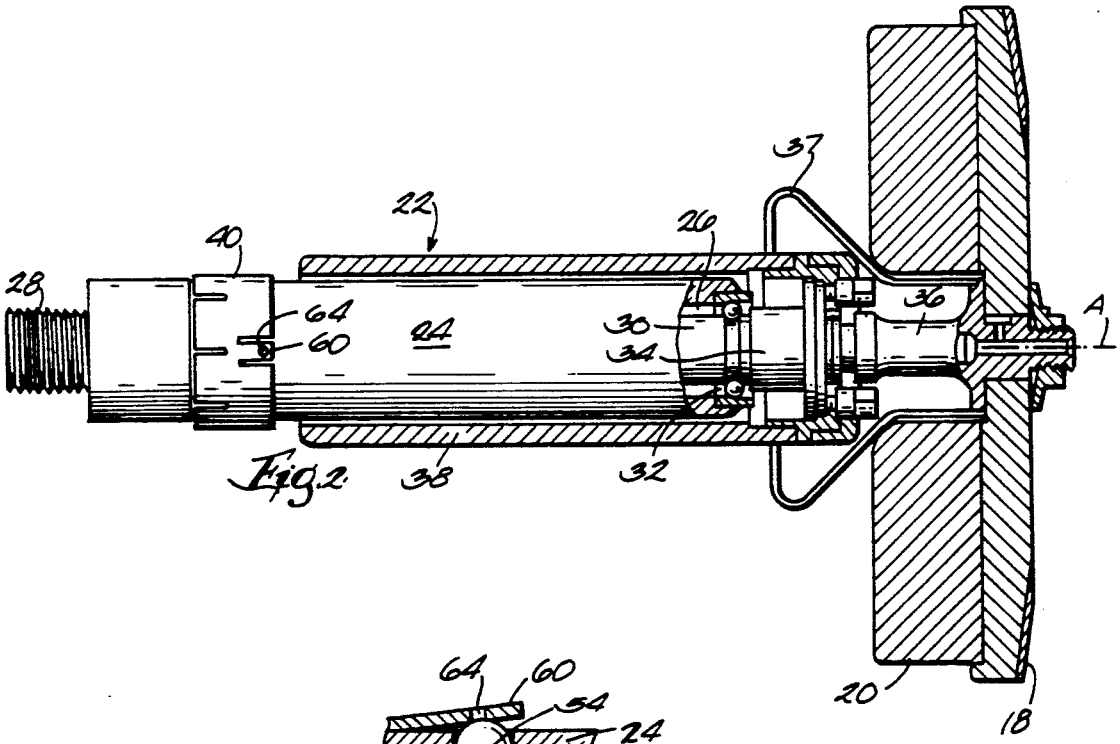
FIG. 2 is a partial sectional view showing the anode and anode support structure for the X-ray tube of FIG. 1.

FIG. 2 shows anode drive and support structure 22 including an anode stem 24, which comprises an elongated member having a bore 26 formed therein and a threaded portion 28 integral thereto. Threaded portion 28 mates with and is supported by bracket 14 (not shown in FIG. 2) to fixably support anode stem 24, along with other stationary components of X-ray tube 10, e.g., envelope 12 and cathode 16, relative to bracket 14. Bore 26 has a circular cross-section.

FIG. 2 further shows an anode shaft 30 journaled within the bore 26 of anode stem 24 by means of a front bearing 32 and a rear bearing (not shown in FIG. 2). Shaft 30 and anode stem 24 both have axes aligned along the axis A of bore 26. A hub 34 is joined to shaft 30 for rotation therewith, and an anode stud 36 is joined to the hub 34. The anode 20 is fixed to hub 34 by means of stud 36 and bellville nut 37. Thus, anode 20 is tied to anode shaft 30, through hub 34 and stud 36, for rotation in unison therewith.

FIG. 2 shows a cylindrical copper rotor sleeve 38 fitted around anode 24 and carried upon hub 34 for rotation around stem 24, in unison with rotation of shaft 30 and anode 20. Rotor sleeve 38, which is of conventional design, is positioned within a set of stator windings (not shown) of an induction motor when tube 10 is mounted for operation. When the stator windings are excited to generate a magnetic field, rotor sleeve 38 serves as an armature for the motor, and is thus driven to rotate anode 20 and shaft 30.

FIG. 2 also shows a radial retaining ring 40 positioned around anode stem 24. Retaining ring 40 comprises an important component of the invention disclosed and claimed herein, and is described hereinafter in greater detail.

Figure 3:
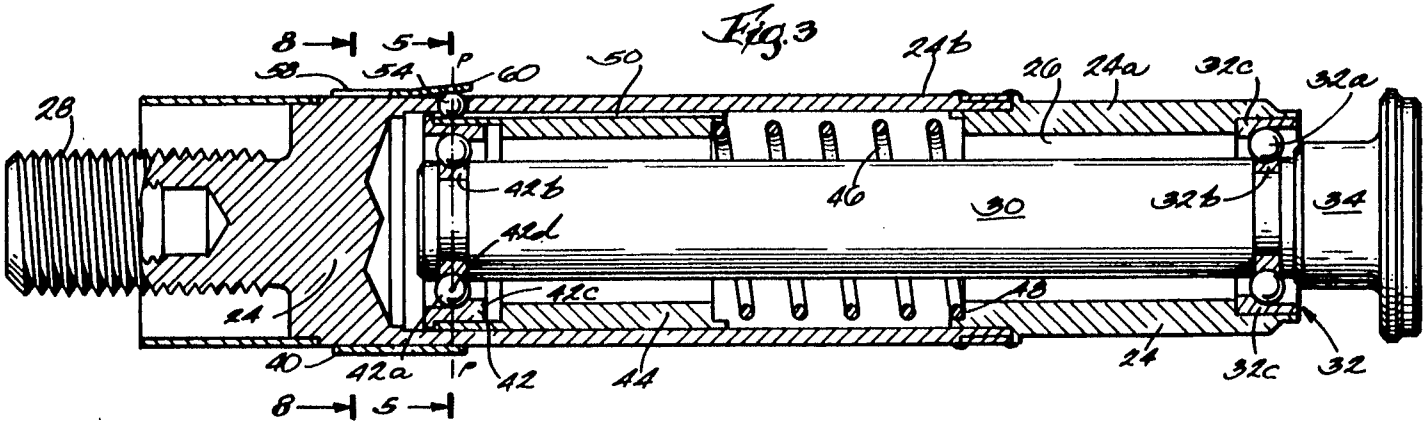
FIG. 3 is a sectional view taken through the anode support structure to show an embodiment of the invention.

FIG. 3 shows anode shaft 30 rotatably supported within anode stem 24 by means of the front bearing 32, as well as by a rear bearing 42. Stem 24 is shown to comprise front and rear components 24*a* and 24*b*, respectively. Preferably, front bearing 32 comprises a train of bearing balls 32*a* trapped in an annular path between an inner race 32*b* mounted upon shaft 30, and an outer race 32*c*, mounted upon stem 24. Rear bearing 42 comprises a train of bearing balls 42*a* likewise trapped in an annular path, between an inner race 42*b*, mounted upon shaft 30, and an outer race 42*c*, carried upon a rear bearing retainer 44.

Rear bearing retainer 44, described hereinafter in greater detail, is a cylindrical sleeve-like member fitted within bore 26 and around shaft 30, in coaxial relationship. A slight clearance is provided between the cylindrical outer surface of rear bearing retainer 44 and the wall of bore 26, so that rear bearing retainer 44 is movable or displaceable axially along the bore. A preloading spring 46 is positioned within bore 26 around shaft 30, and acts between displaceable retainer 44 and shoulder 48 formed in stationary front stem component 24*a*. The preloading spring 46 thus tends to urge bearing retainer 44 leftward, as viewed in FIG. 3. Bearing race 42*c*, carried upon bearing retainer 44, is thereby urged against balls 42*a* to apply a preload thereto. The preload force also urges shaft 30 leftward, as viewed in FIG. 3, so that preload force is transmitted therethrough to front bearing 32.

Thus far, the description of the embodiment has been directed to a conventional arrangement for supporting an X-ray tube anode for rotation. This has been done to ensure that the environment in which the invention is preferably practiced is clearly understood. In particular, such environment includes an elongated shaft member, such as shaft 30, which is inserted into the bore of a tubular member, such as the rightward portion of anode stem 24 (as viewed in FIG. 3), with a bearing such as rear bearing 42 being positioned to support the two members in rotational relationship. A preloading element, such as rear bearing retainer 44, must be able to move axially along the bore to selectively preload the bearing, and also to take up expansion and contraction resulting from heating and cooling. Thus, a slight clearance, referred to above, must be provided between the preloading element and the wall of the bore. At the same time, rotational and radial movements of the preloading element and the bearing, with respect to the bore wall, have undesirable effects and must be prevented.

Figure 4:
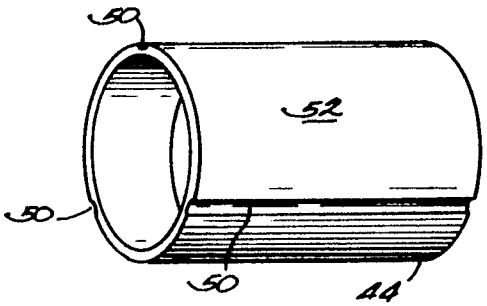
FIG. 4 is a perspective view showing a rear bearing retainer for the embodiment of FIG. 3.

Turning now to the specific features of the invention, FIG. 4 shows three longitudinal grooves 50 machined or otherwise formed along the length of the outer surface 52 of rear bearing retainer 44. Preferably, grooves 50 are radially spaced around the circumference of outer cylindrical surface 52, in equidistant relationship, that is, at a spacing of 120° from one another. The grooves 50 are in parallel relationship with bore axis A when bearing retainer 44 is inserted in bore 26.

Figure 5:
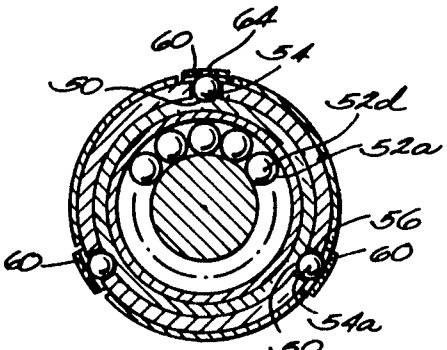
FIG. 5 is a sectional view taken along lines 5—5 of FIG. 3.

Referring to FIGS. 3 and 5 in conjunction, there is shown a locking ball 54 positioned in each of the grooves 50 and extending outward through a corresponding hole 56 formed through anode stem 24, that is, through the wall of bore 26. Each ball 54 is sized to fit very closely within its corresponding groove 50 and annular stem hole 56. Thus, the balls 54, acting between the anode stem 24 and bearing retainer 44, serve to lock the bearing retainer against rotational movement with respect to the anode stem 24.

FIG. 5 shows each groove 50 having a cross-section which closely matches the cross section of the portion of the locking ball 54 located therein.

Figure 6:
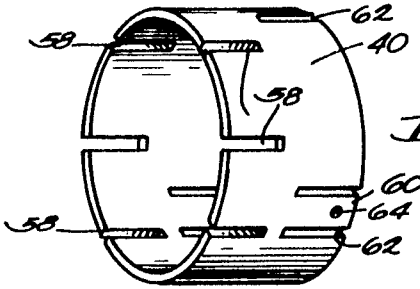
FIG. 6 is a perspective view showing a radial retaining ring for the embodiment of FIG. 3.

FIG. 6 shows radial retaining ring 40 comprising an annular spring provided with slots 58 to enhance its resiliency. Three fingers 60 are formed in ring 40, by means of other slots 62, and a locking ball engagement hole 64 is formed through each finger 60.

Referring once more to FIGS. 3 and 5 in conjunction, there is shown radial retaining ring 40 positioned around anode stem 24. Each of the fingers 60 is force-fitted over a corresponding locking ball 54, to urge the ball inward toward the bore 26 and into tight engagement with bearing retainer 44. The inwardly directed force of the bearing retaining ring 40, acting through the respective balls 54, opposes any force tending to radially displace bearing retainer 44 and the outer bearing race **42*c*, carried thereon, within bore 26. Such radial displacement would move the bearing retainer axis out of alignment with bore axis A and is prevented by ring 40 and balls 54 working together. The force applied to the balls 54 by ring 40 is generally uniform and is sufficient to maintain bearing retainer 44 in a fixed radial position with respect to the wall of bore 26**.

Figure 7:
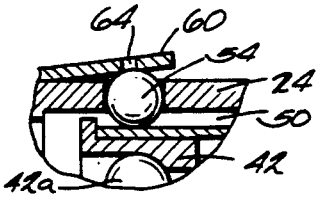
FIG. 7 shows a portion of FIG. 3 in greater detail.

FIG. 7 shows the edges of a hole 64 in a finger 60 positioned to grip the curvature of the corresponding ball 54, and thereby assist in maintaining the finger in position on the ball.

Figure 8:
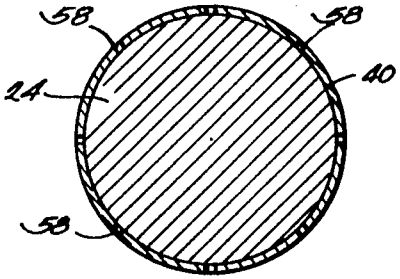
FIG. 8 is a sectional view taken along lines 8—8 of FIG. 3.

FIG. 8 shows the rearward portion of retaining ring 40 fitted around anode stem 24 in tightly gripping relationship.

Referring yet again to FIGS. 3 and 5 in conjunction, there is shown locking balls 54 respectively positioned so that the respective centers **54*a* of the locking balls 54 lie in a common plane P with the respective centers 42*d* of the balls 42*a* of rear bearing 42. Plane P is orthogonal to bore axis A. While not essential to the invention, such positioning of the locking balls 54 with respect to the bearing balls 42*a* enables the locking balls 54 to directly oppose the radial dynamic forces presented by the bearing balls 42*a***.

As stated above, a slight clearance is provided between bearing retainer 44 and the bore wall. Since the grooves 50 are respectively aligned in parallel relationship with the bore axis A, axial movement of bearing retainer 44 is unimpeded by the locking balls 54 in the grooves 50, which are free to rotate within their respective holes 56. Thus, bearing retainer 44 is displaceable axially along the bore over the distance required to apply a preload to the bearings, for all temperature ranges of X-ray tube operation. At the same time, as stated above, the balls 54 act against stem 24 to prevent rotational movements of the bearing retainer within the bore 26, and the balls 54 and retaining ring 40 together prevent oppose radial movements. Balls 54 and ring 40 also provide radial damping of the bearing retainer to minimize excitation from rotor unbalance forces.

The above embodiment pertains to an arrangement in which anode stem 24 is held stationary and rotatable shaft 30 extends into a bore in stem 24. However, the invention disclosed and claimed herein would also apply to a modification in which an anode or the like was mounted for rotation in unison with a member in which a bore was formed, and a shaft extending into the bore was maintained stationary to support the anode.

While a preferred embodiment of the invention has been shown and described herein, it will be understood that such embodiment is provided by way of example only. Numerous variations, changes and substitutions will occur to those skilled in the art without departing from the spirit of the invention. Accordingly, it is intended that the appended claims cover all such variations as followed in the spirit and scope of the invention.

What is claimed is:

1. In an X-ray tube having a mounting structure and an anode, apparatus for supporting the anode for rotation with respect to the mounting structure comprising:

a first elongated member fixed to the mounting structure, a bore and a plurality of holes being formed in the first member;

a second elongated member fixed to the anode for rotation therewith and aligned along the bore axis;

a bearing comprising an annular train of bearing balls proximate to the bore for supporting one of the members for rotation with respect to the other member;

a preloading element positioned in the bore and displaceable along the bore axis for transmitting a selected preloading force to the bearing, the preloading element being provided with a plurality of linear guideways;

a plurality of locking balls, each partially positioned in one of the guideways, and partially positioned in one of the holes formed in the first member for limiting movement of the preloading element to translational movement along the bore axis;

means for retaining each of the locking balls in its respective position relative to the preloading element and the first member; and the holes formed in the first member are located with respect to the bearing to position the centers of the locking balls in a common plane with the centers of the bearing balls.

2. The apparatus of claim 1 wherein:

the apparatus includes means for urging the preloading element along the bore axis toward the bearing to selectively preload the bearing.

3. The apparatus of claim 1 wherein:

each of the guideways comprises a groove formed in the preloading element and oriented in parallel relationship with the bore axis; and the retaining means comprises means for applying a force to the preloading element through each of the locking balls to maintain the preloading element in a fixed radial relationship with the wall of the bore.

4. The apparatus of claim 3 wherein:

the retaining means applies substantially the same amount of force to each of the locking balls.

5. The apparatus of claim 3 wherein:

the preloading element has a cylindrical outer surface;

the grooves are formed in said cylindrical outer surface, in spaced-apart relationship with one another around the circumference of the surface; and each of the holes is formed through the first member in closely spaced-apart relationship with a corresponding groove.

6. The apparatus of claim 5 wherein:

the retaining means comprises an annular retaining spring fitted around the first member and contacting each of the locking balls for urging the locking balls in toward the bore and against the preloading element.

7. The apparatus of claim 6 wherein:

each of the holes formed through the first member is sized to enable a ball to be inserted through the hole into one of the grooves in the preloading element, the inserted balls being kept in place by action of the annular retaining spring.

8. The apparatus of claim 3 wherein:

the second member comprises a shaft at least partially received into the bore of the first member;

the bearing is located in the bore for supporting the second member and the anode for rotation with respect to the first member, the bearing having inner and outer races; and the preloading element comprises a bearing retainer supporting the outer bearing race for selected displacement along the bore axis to preload the bearing.

9. In an X-ray tube having a mounting structure, an anode and a mechanism supporting the anode for rotation, wherein the mechanism comprises a stem in fixed relation with the mounting structure, a shaft fixed to the anode, and a bearing comprising an annular train of bearing balls positioned to support the shaft and anode for rotation with respect to the stem, apparatus to selectively preload the bearing comprising:

a preloading element positioned within a bore formed in the stem and displaceable along the axis of the bore to apply a selected preloading force to the bearing, the preloading element having an outer surface provided with a plurality of grooves in parallel relationship with the bore axis;

a locking ball partially located in each of the grooves and partially located in a hole formed in the stem to constrain movement of the preloading element relative to the stem to translational movement along the bore axis, the holes formed in the stem being selectively positioned so that the centers of the locking balls and of the bearing balls lie in a common plane orthogonal to the axis of the bore; and means for applying a force to the preloading element through the locking balls to resist radial movement of the preloading element within the bore.

10. The apparatus of claim 9 wherein:

the apparatus includes preloading means for selectively urging the preloading element along the bore axis to apply the preloading force to the bearing.

* * * * *